United States Patent [19]

Lemire

[11] Patent Number: 4,492,286

[45] Date of Patent: Jan. 8, 1985

[54] TRUCK MOUNTED LADDER ASSEMBLY

[76] Inventor: David H. Lemire, Rte. 3, Box 36, Lugoff, S.C. 29078

[21] Appl. No.: 379,270

[22] Filed: May 17, 1982

[51] Int. Cl.[3] ..... E06C 5/00

[52] U.S. Cl. ..... 182/93; 182/127

[58] Field of Search ..... 182/93, 94, 127, 217, 182/194, 99, 228; 280/163, 164 R; 296/183, 184

[56] References Cited

U.S. PATENT DOCUMENTS

| | | | |
|---|---|---|---|
| 83,305 | 10/1868 | Panchot | 182/93 |
| 1,149,368 | 8/1915 | Johnson | 182/90 |
| 1,401,257 | 12/1921 | Houghtaling | 182/119 |
| 1,714,451 | 5/1929 | Saunage | 182/93 |
| 2,239,798 | 4/1941 | Tinnerman | 16/114 R |
| 2,478,247 | 8/1949 | Conley | 16/114 R |
| 2,630,261 | 3/1953 | Nystrom | 182/93 |
| 2,776,793 | 1/1957 | Nystrom | 182/93 |
| 3,318,413 | 5/1967 | Werner | 182/228 |
| 3,390,740 | 7/1968 | Brandel | 182/93 |
| 3,804,200 | 4/1974 | Sandberg | 182/228 |
| 3,908,795 | 9/1975 | Gannon | 182/93 |
| 4,049,082 | 9/1977 | Reid | 182/217 |
| 4,067,588 | 1/1978 | Morge | 280/163 |
| 4,174,117 | 11/1979 | Slosiarek | 280/163 |
| 4,232,760 | 11/1980 | Becht | 182/93 |
| 4,284,171 | 8/1981 | Owen | 182/119 |
| 4,324,434 | 4/1982 | Friese | 280/163 |

FOREIGN PATENT DOCUMENTS

| | | | |
|---|---|---|---|
| 1459219 | 12/1976 | United Kingdom | 16/D24 |

*Primary Examiner*—Reinaldo P. Machado
*Assistant Examiner*—Alvin Chin-Shue
*Attorney, Agent, or Firm*—Dority & Manning

[57] ABSTRACT

A ladder assembly for use on large trucks for providing entrance into and egress from the body of the truck. The ladder assembly includes an exterior ladder which is constructed of tubular metal that is die rolled on the corners providing vertical rails and a bottom rung which are formed from a singe tubing member. Fastening devices are provided for securing the exterior ladder to the side wall. There is an interior ladder positioned directly opposite the exterior ladder which is also constructed of tubular metal and has fasteneners positioned adjacent the upper and lower ends of the rails. The same fasteners or bolts are used for securing the upper ends of the interior ladder to the side walls as the exterior ladder.

3 Claims, 4 Drawing Figures

TRUCK MOUNTED LADDER ASSEMBLY

BACKGROUND OF THE INVENTION

One problem with utilizing large trucks which have bodies with relatively tall side walls is that it is difficult to obtain access to the interior of the load-carrying compartment. For example, when grain such as wheat and the like is loaded in the truck, it is difficult for a person to gain access to the interior of the truck body. Normally, it is necessary to climb over the cabin area of the truck. Such is not only inconvenient, but is dangerous due to the possibility of falling. Furthermore, once access to the interior of the truck is obtained, it is difficult for large people to climb out of the interior of the truck. While ladder assemblies have been provided in the past on railroad cars and the like such as shown in U.S. Pat. No. 1,714,451, such ladder assemblies are not practical and readily mountable on trucks which have relatively thin side walls. Conventional step ladders have been carried by truckers, however, such are very impractical and is also inconvenient to store on the side of the truck.

While there are ladder constructions capable of being positioned on both sides of a wall so that one can readily climb over the wall, such ladders would not be practical for use on a truck having high side walls since they normally require at least one leg of the ladder to rest on the ground. Examples of such ladders are disclosed in U.S. Pat. Nos. 3,908,795, 4,284,171, and 1,401,257.

SUMMARY OF THE INVENTION

In order to avoid the problems encounted with large open-top trucks, a ladder assembly constructed in accordance with the present invention is provided to be mounted on the side wall of the truck. The exterior portion of the ladder assembly includes a pair of laterally spaced vertically extending side rails constructed of a single length of square tubing integrally joined at the bottom by a horizontally extending rung. Vertically extending rungs extend between the side rails and a fastening device is carried by the ladder for securing a lower portion of the ladder to the bed of the truck. The upper ends of the rails are bent inwardly ninety degrees (90°) to the vertically extending portion of the rails towards the outside wall of the truck body. A threaded bolt receiver is inserted within the ends of the tubular rails so that the ladder assembly can be secured to the wall of the truck by merely extending two bolts through the wall of the truck into the ends of the rails.

The rails have four corners provided therein, two adjacent the top and two adjacent the bottom. These corners are bent at right angles and prior to being bent, a die rolls concave grooves in three sides of the tubular rails. The outer side opposite the radius of the bend is smooth and, as a result, such is substantially strengthened as compared to conventional bending and stretching of tubular metal.

There is a second ladder assembly provided on the interior wall of the truck body, and it includes a pair of laterally spaced rails constructed of the same type of square tubing which are joined together by at least one rung. The upper ends of the rails of the interior ladder are bent inwardly and have mounted thereon a bolt receiver. As a result, the same bolts used to secure the upper ends of the exterior ladder to the side wall are used for securing the upper ends of the interior ladder. The lower ends of the interior ladder are bolted to the side wall by bolts extending from the outside of the side walls inwardly.

As can be seen, the ladder assembly can be readily mounted on the wall of a truck with a minimum number of bolts.

Accordingly, it is an important object of the present invention to provide a simple and relatively strong ladder assembly for providing access and egress from large trucks.

Another important object of the present invention is to provide a ladder assembly that can be readily mounted on the wall of a truck while adding structural strength to the side wall of the truck.

Still another important object of the present invention is to provide a relatively inexpensive and simple but efficient ladder assembly for large trucks.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF THE PREFERRED EMBODIMENT

Figure 1:
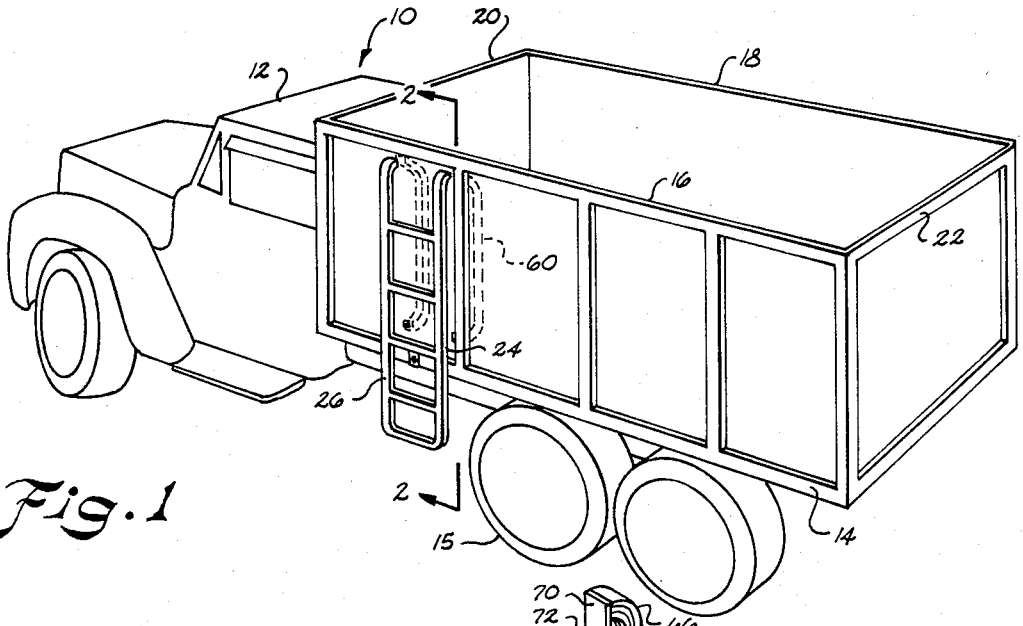
FIG. 1 is a perspective view illustrating a ladder assembly constructed in accordance with the present invention mounted on the side wall of a large truck.
Figure 2:
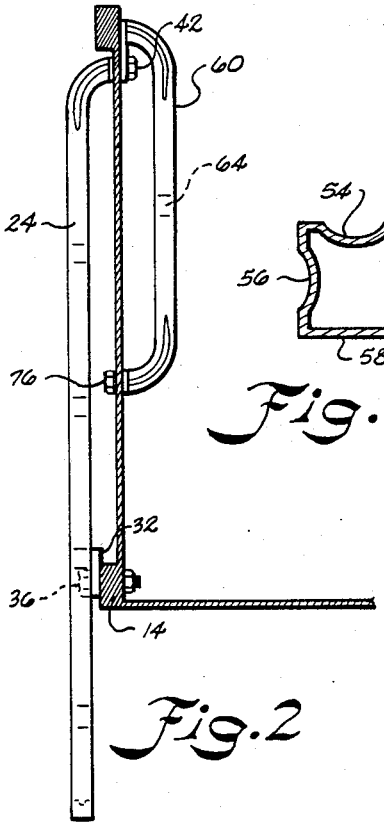
FIG. 2 is a sectional view taken along line 2—2 of FIG. 1.
Figure 4:
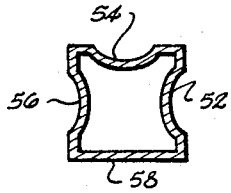
FIG. 4 is an enlarged sectional view showing the bends in the rails of the ladder at the corners.
Figure 3:
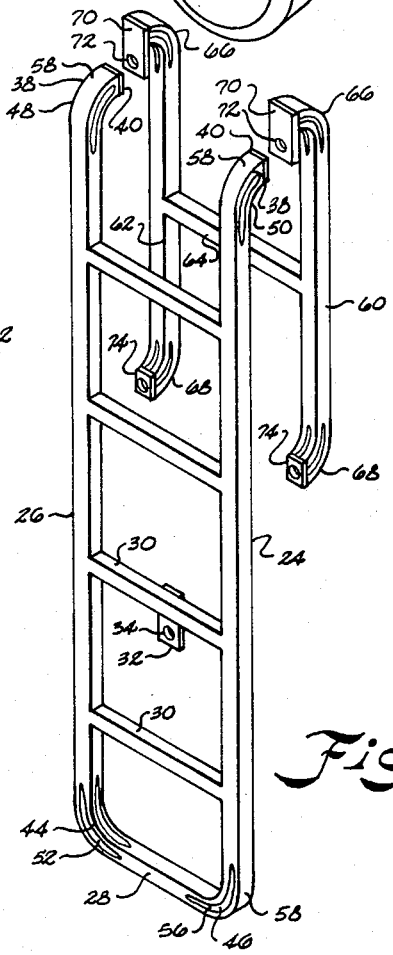
FIG. 3 is an enlarged perspective view showing the ladder assembly prior to being mounted on a truck.

As illustrated in FIG. 1 of the drawing, there is shown a large truck 10 having a cab 12 and a bed 14 that is supported on wheels 15. Extending upwardly from the bed 14 are side walls 16 and 18 that are joined by end walls 20 and 22. This is a typical truck that is used for hauling grain and the like, and one problem is obtaining access to the interior of the body. Furthermore, once access has been gained to the interior of the body, it is difficult to get out of the body.

In order to provide easy access to and egress from the body of the truck, a ladder assembly is provided for being mounted on the side wall of the truck.

The ladder assembly includes a pair of laterally spaced vertically extending side rails 24 and 26 which are constructed of a single length of square tubing so that the lower portions of the rails 24 and 26 are joined by a horizontally extending rung 28. Vertically spaced rungs 30 extend between the side rails and are secured in position by welding. The rails and rungs may be constructed of any suitable metallic material depending on the strength desired and in order to increase the strength thereof are constructed of tubular metal. A fastening device in the form of a flange 32 is welded to one of the lower rungs and has a bore 34 provided therein so that a stud 36 can be inserted therethrough for securing the lower portion of the ladder to the bed 14 of the truck. The upper ends 38 of the rails are bent inwardly ninety degrees (90°) to the vertically extending portion of the rails towards the outside wall of the body. A threaded bolt receiver 40 is carried by the upper ends of the rails. In one particular embodiment, this threaded bolt receiver is a square shaped insert which corresponds to the opening in the end of the tubular rails that has a threaded bore provided therein. The insert is normally welded in the end of the tube. Bolts 42 extend through the side wall 16 of the truck for securing the upper ends of the ladders to the wall thereof.

The rails 24 and 26 have right angle corners 44 and 46 at the junction of the side rails and the bottom rung 28 and also has corners 48 and 50 at the junction of the side rails and the inwardly bent upper ends 38. These corners are formed by bending the tubular rails using a roll die that depresses three sides of the corners forming depressions 52, 54, and 56 about the corner. The outer surface 58 of the corners opposite the radius of the bend is smooth. As a result of die forming or die shaping in the above mentioned manner, the corners are strengthened rather than being weakened by the bending operation.

The ladder assembly includes a second ladder carried on the inside wall of the body opposite the exterior ladder. The second ladder includes a pair of laterally spaced vertically extending side rails 60 and 62 which are constructed of tubular metal. At least one horizontally extending rung 64 joins the two side rails. The upper ends 66 of the side rails are bent inwardly at a right angle towards the inner wall of the truck body. Similarly, the lower ends 68 of the rails 62 and 60 are bent inwardly. A bolt receiving fastener 70 is welded to the upper ends of the rails 60 and 62 and have a hole 72 provide therein through which the bolt 42 extends when securing the interior ladder to the side of the wall of the truck. It is noted that the same bolts 42 are used for securing the interior ladder as are used for securing the upper end of the exterior ladder.

The lower ends of the interior ladder have threaded fasteners 74 welded into the tubular ends of the rails so that they can be fastened to the interior of the side walls 16 by means of bolts 76 which are inserted from the outside of the truck inwardly.

As a result of the ladders being spaced opposite each other, they tend to strengthen the side walls rather than weakening the side walls.

While a preferred embodiment of the invention has been described using specific terms, such description is for illustrative purposes only, and it is to be understood that changes and variations may be made without departing from the spirit or scope of the following claims.

What is claimed is:

1. A ladder assembly for use on trucks to provide access to the interior of an open top body of said truck which includes vertically extending high side walls and end walls which are supported on a bed comprising:

a pair of laterally spaced vertically extending side rails constructed of a single length of square tubing integrally joined at the bottom by a horizontally extending rung;

vertically spaced rungs extending between said side rails;

a fastening device carried by said ladder securing a lower portion of said ladder to the bed of said truck;

upper ends of said rails being bent inwardly ninety degrees to said vertically extending portion of said rails towards the outside wall of said body so as to mount perpendicular to said outside wall of said body, said upper bent-in ends holding said side rails away from said side walls of said truck;

said rails having right angeled corners at the junction of said side rails and said bottom rung and at the junction of said side rails and said inwardly bent upper ends;

three sides of said tubing at said corners being bent inwardly by a forming die producing reinforcing sections and a fourth outer side opposite the radius of bend being smooth providing strenthened corners;

a threaded bolt receiver carried by the upper ends of said rails; and bolts extending through said side wall of said body into said threaded bolt receivers and into the hollow of the tubing securing said ladder to said wall.

2. The ladder assembly as set forth in claim 1 further comprising:

said threaded bolt receiver being welded in the upper ends of said tubular rails.

3. A ladder assembly for use on trucks to provide access to the interior of an open top body of said truck which includes vertically extending high side walls and end walls which are supported on a bed comprising:

a pair of laterally spaced vertically extending side rails constructed of a single length of square tubing joined at the bottom by a horizontally extending rung;

vertically spaced rungs extending between said side rails;

a fastening device carried by said ladder securing a lower portion of said ladder to the bed of said truck;

upper ends of said rails being bent inwardly ninety degrees to said vertically extending portion of said rails towards outside wall of said body;

a threaded bolt receiver carried by the upper ends of said rails;

bolts extending through said side wall of said body into said threaded bolt receivers securing said ladder to said side wall; and a second ladder for being carried on an inside wall of said body opposite said ladder assembly carried on said outside wall;

said second ladder including:

(i) a pair of laterally spaced vertically extending side rails constructed of square tubing;

(ii) at least one horizontally extending rung carried between said vertically extending side walls;

(iii) upper ends of said rails being bent inwardly ninety degrees to said vertically extending side rails towards the inside wall of said body;

(iv) a bolt receiver carried by said upper ends of said rails; and said bolts extending through said side wall of said body into said threaded bolt receivers carried by the upper ends of said rails of said ladder carried on said outside wall also extending through said bolt receivers carried by said upper ends of said rails of said second ladder assembly carried on the inside wall.

* * * * *